US005366301A

United States Patent [19]

Martin et al.

[11] Patent Number: 5,366,301

[45] Date of Patent: Nov. 22, 1994

[54] RECORD MEDIA GAP ADJUSTMENT SYSTEM FOR USE IN PRINTERS

[75] Inventors: Paul W. Martin, Battle Ground; Cathy A. Rotering, Camas, both of Wash.

[73] Assignee: Hewlett-Packard Company, Palo Alto, Calif.

[21] Appl. No.: 166,418

[22] Filed: Dec. 14, 1993

[51] Int. Cl.[5] ..... B41J 11/20

[52] U.S. Cl. ..... 400/56; 400/58

[58] Field of Search ..... 400/54, 56, 58, 59, 400/708

[56] References Cited

U.S. PATENT DOCUMENTS

| | | | |
|---|---|---|---|
| 4,384,794 | 5/1983 | Okano et al. | 400/56 |
| 4,575,267 | 3/1986 | Brull . | |
| 4,780,007 | 10/1988 | Weeks et al. | 400/58 |
| 4,784,504 | 11/1988 | Hamano et al. | 400/605 |
| 4,810,110 | 3/1989 | Myers | 400/56 |
| 4,843,338 | 6/1989 | Rasmussen | 271/147 |
| 4,932,797 | 6/1990 | Emenaker et al. . | |
| 5,000,591 | 3/1991 | Burgess | 400/56 |
| 5,000,594 | 3/1991 | Beehler et al. | 400/569 |
| 5,009,526 | 4/1991 | Kirchof | 400/56 |
| 5,065,169 | 11/1991 | Vincent et al. . | |
| 5,074,685 | 12/1991 | Shimizu et al. | 400/56 |
| 5,108,205 | 4/1992 | Stone . | |
| 5,136,937 | 8/1992 | Nogawa | 400/56 |
| 5,156,466 | 10/1992 | Inagaki et al. . | |
| 5,172,987 | 12/1992 | Stellmach et al. . | |
| 5,187,497 | 2/1993 | Hirano et al. | 400/56 |

*Primary Examiner*—Eugene H. Eickholt

[57] ABSTRACT

The present invention relates to a system for use in an ink-jet printer having a printhead and an opposing platen capable of movement toward and away from the printer's printhead to define a record media gap therebetween. The system is effective to selectively restrict movement of a printer's platen to effect adjustment of the record media gap upon detection of record media having a characteristic which warrants such a change. The system is provided with a detector capable of recognizing the characteristic, and with a stop mechanism which acts in concert with the detector to effect the desired change. In its nominal configuration, the stop mechanism limits movement of the platen at a first position so as to define a first record media gap. However, upon detection of record media having the characteristic, the stop mechanism is automatically reconfigured so as to allow movement of the platen to a second position defining a second record media gap.

9 Claims, 4 Drawing Sheets

RECORD MEDIA GAP ADJUSTMENT SYSTEM FOR USE IN PRINTERS

TECHNICAL FIELD

The present invention relates generally to printers and, more particularly, to an ink-jet printer employing a system which automatically adjusts the distance between the printer's platen and printhead. Toward this end, the system utilizes a stop mechanism which effects controlled positioning of the platen based on detected characteristics of the record media to be printed on.

BACKGROUND ART

In a conventional ink-jet printer, ink is deposited on record media via a traveling printhead which propels ink drops onto the record media as it passes thereacross. The record media is spaced from the printhead, the upper surface of the record media being held at a predetermined minimum distance from the printhead ($D_m$). Most printers set distance ($D_m$) using a platen which supports the record media, the platen generally being held in a fixed position relative to the printer's printhead. The distance between the printhead and platen is defined as the record media gap. This gap must accommodate the passage of record media therethrough without smearing, but spacing should be kept to a minimum so as to maximize the quality of print. Consequently, the platen is set at a distance from the printer's printhead which is approximately equal to the nominal record media thickness plus the desired printhead-to-medium spacing ($D_m$).

A problem arises, however, where different types of record media are used, particularly where such record media are of differing thicknesses, or where the different record media experience differing degrees of curl. This situation most commonly arises in ink-jet printers where both paper sheets and envelopes are to be printed on. Envelopes, it will be appreciated, are of a different thickness than paper sheets due to multiple paper layers, and experience increased curl due to the flap and adhesive used. These factors impact on the printhead-to-medium spacing and consequently impact on the overall quality of print. For example, where thicker record media is used, the risk of ink smear is increased. Although the risk of ink smear may be decreased by expanding the record media gap, such an expanse would impact negatively on the accuracy of ink dot placement due to the increase in distance to be traveled by the ejected ink.

One solution to this problem involves the adjustment of the record media gap whenever a new form of record media is used. In the past, this has involved operator-directed adjustment of the printer's printhead or platen, an adjustment which requires complex mechanism and which requires the operator to remember that an adjustment must be made. Printers employing known solutions have therefore been characterized by increased complexity and correspondingly by increased cost. Also, these printers may require an increase in the nominal printhead-to-medium spacing due to increased tolerances involved. This can result in a consequential derogation in the quality of print. There is thus a need for a new solution which addresses the problems associated with printing on record media of different types.

DISCLOSURE OF THE INVENTION

To address the above-identified problems, a system is herein disclosed for use in an ink-jet printer which selectively restricts movement of a printer's platen to effect adjustment of the printer's record media gap. Adjustment is automatically effected in response to detection of a predetermined record media characteristic which indicates a need to adjust the record media gap. Toward this end, the system is provided with a detector capable of recognizing the predetermined characteristic, and with a stop mechanism which acts in concert with the detector to effect the desired change. In its nominal configuration, the stop mechanism limits movement of the platen at a first position so as to define a first record media gap. However, upon detection of record media having the predetermined characteristic, the stop mechanism is automatically reconfigured so as to allow movement of the platen to a second position defining a second record media gap.

In its preferred embodiment, the detector determines the need for gap adjustment based on the width of the record media, the detector being mounted at a predetermined lateral position along the record media path. The preferred detector includes a tab which nominally extends into the path of the record media, but which is movable from the path upon engagement by record media having a width within a predetermined range. Movement of the tab results in consequent movement of the stop mechanism, allowing the platen to move to its second predetermined position so as to establish the second predetermined record media gap.

The objects and advantages of the present invention will be more readily understood after a consideration of the drawings and the detailed description of the preferred embodiment which follows.

DETAILED DESCRIPTION AND BEST MODE FOR CARRYING OUT THE INVENTION

Figure 1:
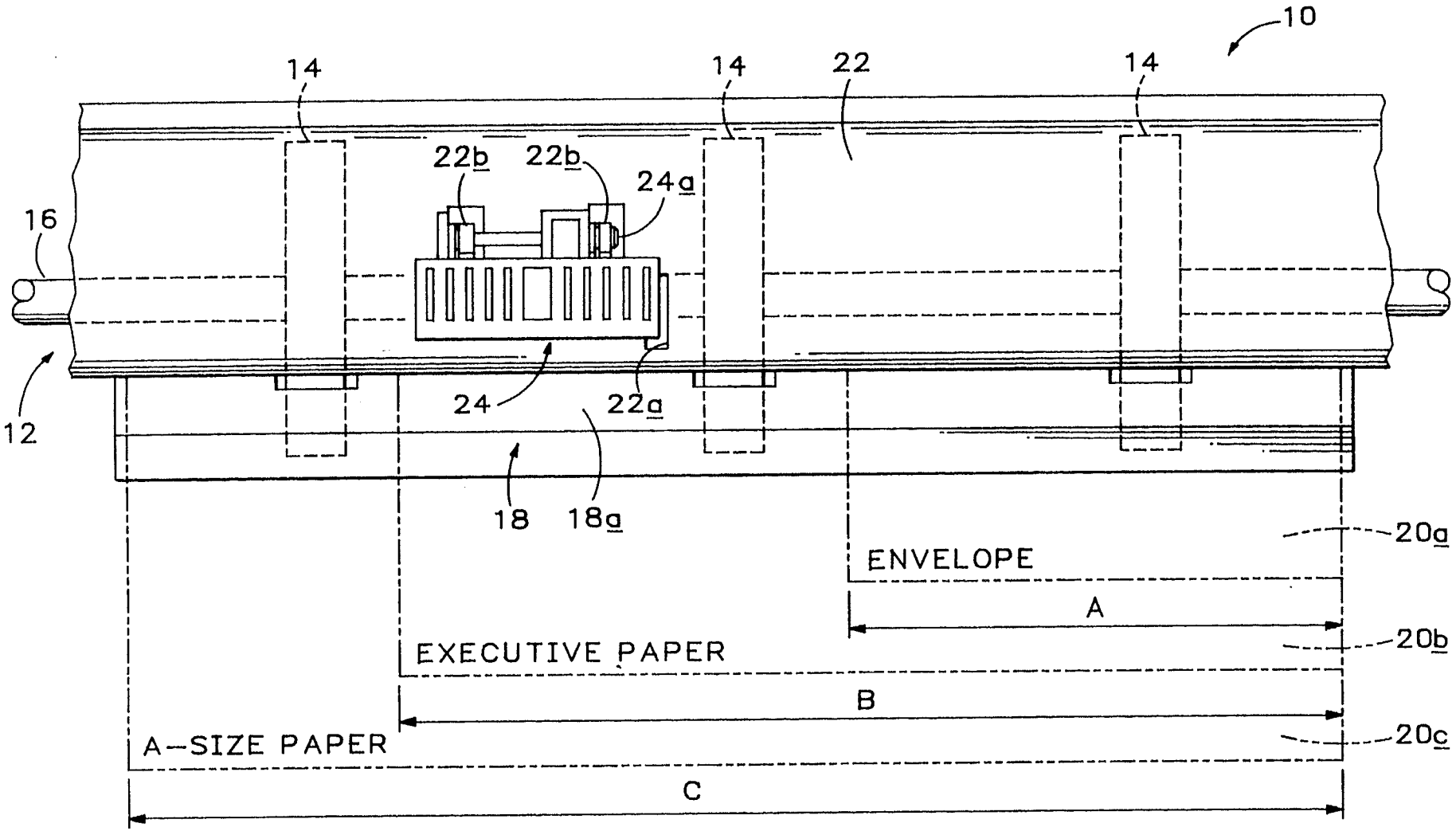
FIG. 1 is a top plan view of a printer which incorporates the invented record media gap adjustment system.

As stated above, the present invention relates to a system for use in an ink-jet printer, such system serving automatically to determine the thickness of record media which is to be processed by printer, and correspondingly to adjust the printer's record media gap. Although the system is particularly well suited for use in an ink-jet printer, those familiar with printer technologies will appreciate that the system may similarly be employed in other style printers which require broadening or narrowing of the record media gap.

Turning now to the drawings, and referring particularly to FIG. 1, it is to be noted that the invented system is illustrated in connection with an ink-jet printer, such printer being indicated generally at 10. As shown, printer 10 employs a record media handling mechanism 12, such mechanism being adapted to direct record media through a predetermined record media path (indicated generally at 32 in FIGS. 2 and 3). Toward this end, mechanism 12 includes a plurality of spaced rollers 14, each of which is operatively connected to a motor-driven drive shaft 16. The mechanism also includes a pivot 18, the pivot being rotatable into various orientations so as to accommodate performance of various printer-related tasks. During a typical print cycle, the pivot rotates between a pick-up orientation which accommodates receipt of record media, and a media-supporting orientation which accommodates receipt of record media, and a media-supporting supporting orientation which accommodates printing thereon. A generally planar platen 18*a* which supports record media during a print operation, the platen being movable with the pivot to define the printer's record media gap. The preferred handling mechanism is described in detail in U.S. Pat. No. 5,000,594 which lists Beehler et al. as inventors and which is commonly owned herewith. The disclosure of that patent is incorporated herein by this reference.

Pursuant to the present invention, it is contemplated that printer 10 will be used in connection with a number of different record media types, the various types of record media making up a predetermined record media set. It is also contemplated that the different types of record media will exhibit different physical characteristics, and that some of the differences between record media types will require adaptation of the printer to compensate for a change in the type of record media used. The present invention addresses the need to adapt the printer based upon variations in record media thickness. This need arises due to conflicting problems of ink smearing and ink placement inaccuracies.

Several of the more common types of record media are depicted in FIG. 1, the illustrated types of record media including an envelope 20*a*, a sheet of executive paper 20*b*, and a sheet of A-size paper 20*c*. Those familiar with ink-jet printing will recognize that such set is representative of the types of media which an ink-jet printer most commonly employs. The record media set, however, would typically also include types of record media such as letter-size and legal-size sheets. It is thus evident that record media of two thickness characteristics are typically employed in an ink-jet printer, dividing the typical record media set into two subsets. The first subset includes multiple layer record media such as envelope 20*a*, and the second subset includes single sheet media such as A-size paper 20*c*. These record media types are chosen to illustrate the invention.

Focusing attention for a moment on the path of record media through the handling mechanism, it is to be noted that such path is defined with a transverse width which corresponds to the maximum width of the record media to be passed therethrough. In the depicted embodiment, the width of the record media path corresponds to the width of conventional A-size paper, but those skilled in the art will recognize that the path width need not be so limited. Most commonly, the record media path would be defined to coincide with the width of letter-size sheets.

FIG. 1 illustrates the flow of the various record media through the handling mechanism, each of the aforementioned record media types being shown in phantom as it is expelled from the printer's output port. As indicated, the record media is justified to the right edge of the record media path, such justification preferably being accomplished by apparatus such as that described in co-pending U.S. Patent application Ser. No. 07/954,540 now U.S. Pat. No. 5,286,018 entitled "Printer Pater Stack-handling Apparatus", which was filed on Sep. 29, 1992, and which is owned commonly herewith. The disclosure of that patent application is incorporated herein by the present reference.

Attention is now drawn to the fact that different types of record media exhibit different physical characteristics, the most note worthy of such characteristics being the media's thickness and width. Because most types of record media exhibit different width characteristics, it often is possible to identify a type of media by determining the media's width. Correspondingly, because media thickness generally is known for a given type of record media, it is possible to identify media thickness simply by determining the media's width. An envelope, for example, generally is thicker than either executive or A-size paper (compare FIGS. 2 and 3), but is not as wide as either executive or A-size paper (see FIG. 1). Record media thickness is in this sense linked to record media width.

Based on the foregoing, it should be apparent that each of the illustrative record media types will extend a known distance from the right edge of the media path (as shown in FIG. 1), such distance corresponding to the media's width. Envelope 20*a*, for example, extends a distance A from the path's right edge, such distance generally corresponding to a width of less than 5-inches across. Executive paper 20*b* extends a distance B from the path's right edge, and A-size paper 20*c* extends a distance C from the path's right edge. Distances B and C correspond to record media widths which fall within a range of between 5-inches and 8.5-inches across. The record media path thus may be considered to consist of two transverse regions, a first region which extends a distance A from the path's right edge, and a second region which extends from the path's first region to the path's left edge. Assuming the aforementioned record media set, it will be understood that all types of record media pass through the first region, and that all record media types except envelope 20*a* pass through the second region. The use of an envelope thus may be passively detected by a noted absence of media in the second region during a print operation. Envelope 20*a*, it will be recalled, makes up the record media subset which requires adjustment of the record media gap.

Figure 2:
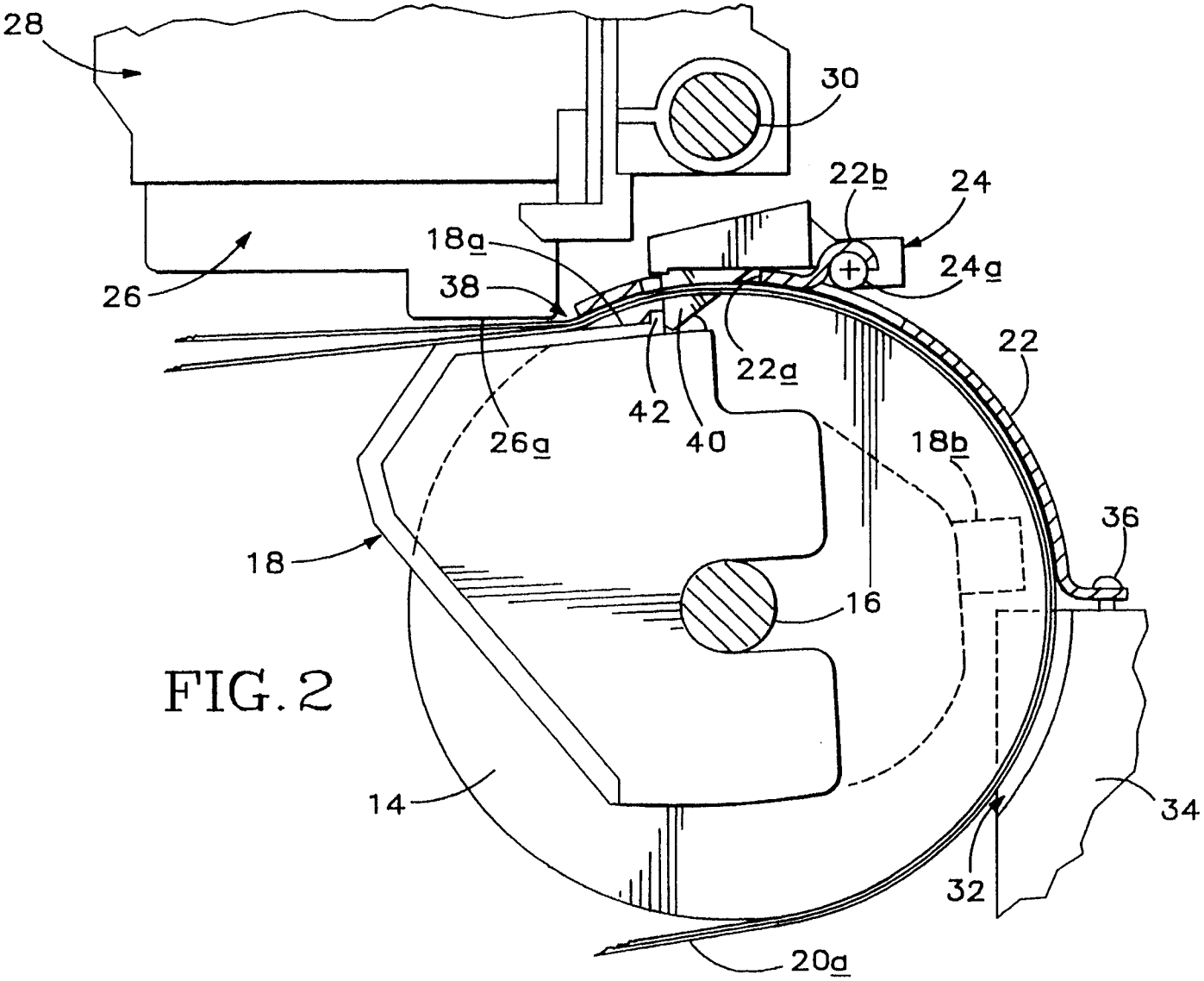
FIG. 2 is a partial side view of the printer in FIG. 1, the system being arranged to illustrate passage of an envelope through the record media gap.
Figure 3:
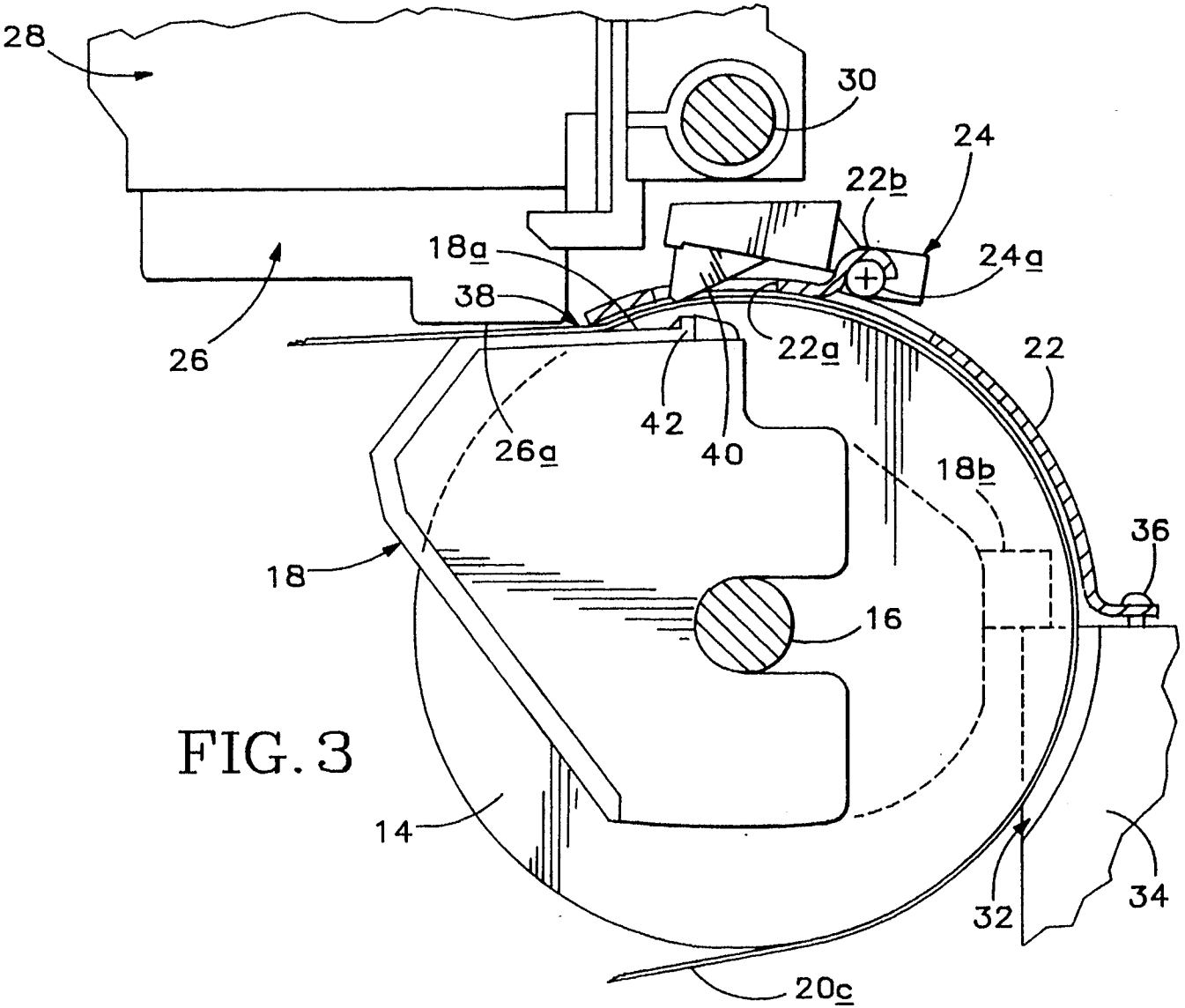
FIG. 3 is a partial side view of the printer in FIG. 1, the system being arranged to illustrate passage of single-sheet media through the record media gap.

As indicated in FIGS. 2 and 3, record media is directed along record media path 32 by the printer's drive rollers 14, and is guided by an arcuate record media guide 22. The guide is fixed to printer chassis 34 by suitable securement structure such as that indicated at 36. The rollers and guide are spaced to allow passage of the different types of record media therebetween, such space generally being defined in accordance with the maximum thickness of the record media to be passed therethrough. In the current embodiment the space between the rollers and record media guide is approximately equal to the thickness of envelope 20*a*.

Having reviewed the pertinent characteristics of the different types of record media, attention may now be given to the invented adjustment system, such system being capable of adapting the printer to compensate for known variations in record media thickness arising from the use of different record media types. These variations are identified using a record media detector 24 which senses the presence or absence of record media at a predetermined transverse position along the record media path. The detector thus includes mounting bosses 24a which are captured by hinge members 22b so as to pivotally mount the detector to record media guide 22.

As best illustrated in FIG. 1, the detector is mounted in a predetermined transverse position which accommodates active detection of record media within the path's second transverse region. Correspondingly, the detector passively detects record media in the path's first transverse region by noting an absence of record media in the second transverse region. For reasons previously discussed, the presence of record media in the second transverse region during a print operation is indicative of relatively thin record media such as executive paper 20b or A-size paper 20c. The absence of record media in the second transverse region during a print operation is indicative of relatively thick record media such as envelope 20a.

Upon determining record media thickness, the system acts automatically to adjust the printer's record media gap, such gap being defined as the distance between platen 18a and the printer's printhead 26a. Printhead 26a, it will be appreciated, is the ink-ejecting surface of an ink-jet pen 26. As is conventional, ink-jet pen 26 deposits ink on record media as the pen passes across the media in motions known as print swaths. The pen is carried through such motions by a pen carriage 28 which is movable along a transverse shaft 30. In order to decrease the risk of inaccuracies, the vertical position of the printhead is fixed. The platen is moved with the pivot to adjust the record media gap.

As previously indicated, pivot 18 is rotatable about shaft 16, pivotal rotation of the pivot effecting corresponding movement of platen 18a. Such movement results in adjustment of the record media gap, the platen being movable toward or away from the printer's printhead. In the preferred embodiment, the pivot is biased toward a clockwise rotational direction (as viewed in FIGS. 2 through 5), such bias tending to urge the platen toward the printhead and thus into a position which accommodates printing. Bias is provided by conventional bias mechanism such as a yieldable spring (not shown).

Figure 4:
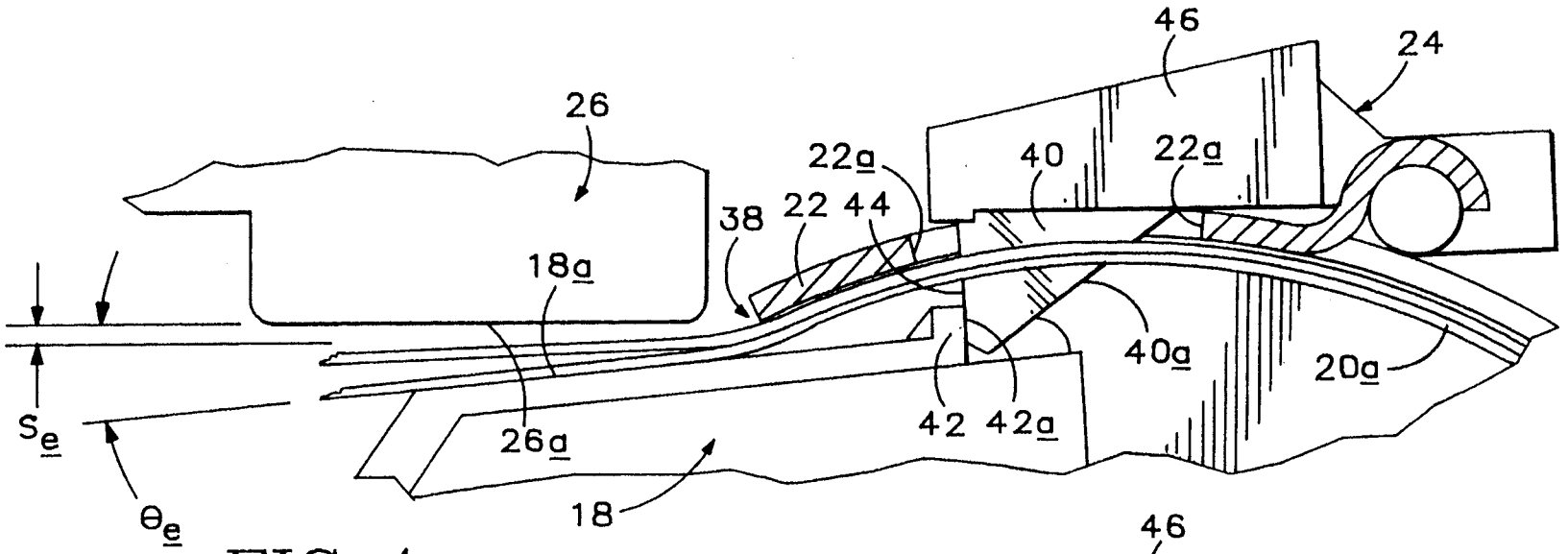
FIG. 4 is a fragmentary enlargement of FIG. 2, showing the invented system in detail.

Referring now specifically to FIGS. 2 and 4, the pivot is shown in its nominal print orientation, such orientation being defined by a relationship between pivot 18 and record media detector 24. As indicated, the detector includes a downwardly extending tab 40 which normally passes through an opening 22a in record media guide 22. The tab engages a protuberance 42 on the pivot 18 upon rotation of the pivot in from a pick-up orientation to the printing orientation shown. The protuberance is engaged by a stop mechanism which is defined by surface 44 on detector 24. Those skilled in the art will recognize that although the depicted stop mechanism forms a part of the record media detector, various other forms of stop mechanism may similarly be employed. As indicated, the stop mechanism engages a facing surface 42a of protuberance 42, such engagement effectively defining the record media gap.

Figure 5:
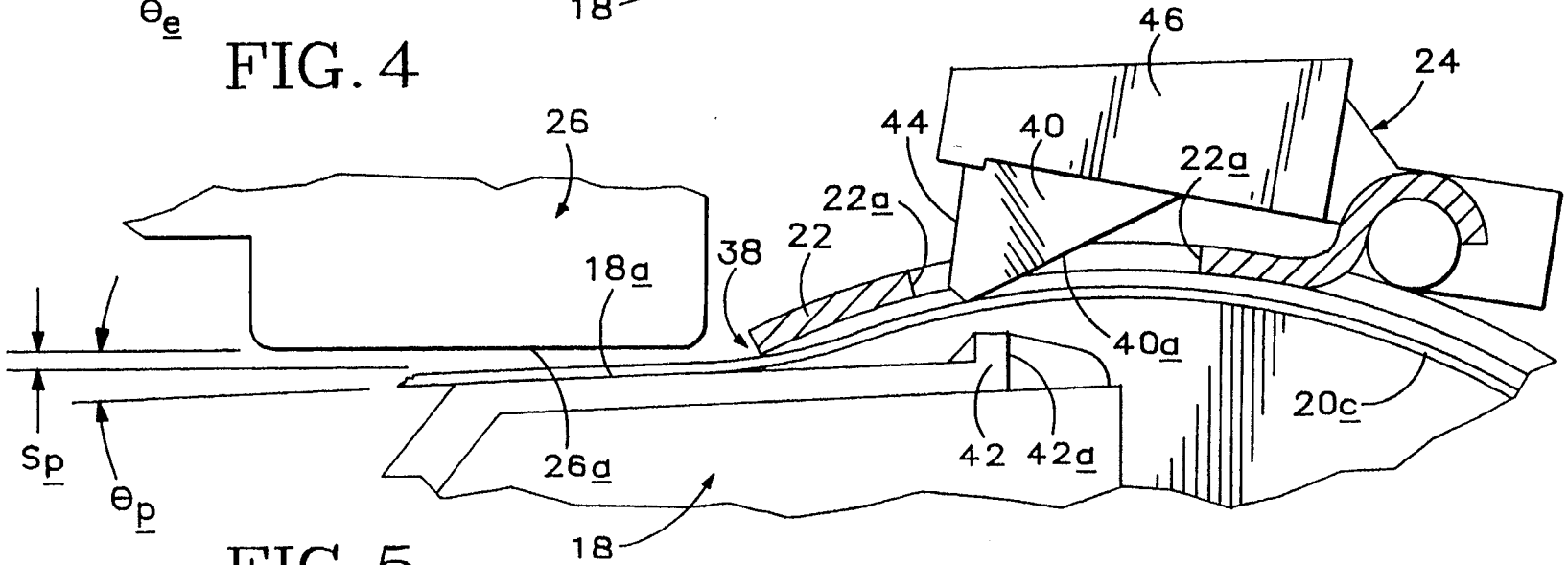
FIG. 5 is a fragmentary enlargement of FIG. 3, showing the invented system in detail.

Focusing attention on FIG. 4, it will be noted that the stop mechanism 44 halts rotation of pivot 18 when platen 18a is in a first predetermined position so as to define a first predetermine drecord media gap. The record media gap is defined as the gap between the printhead and the platen, and nominally is arranged to accommodate passage of an envelope therethrough. The corresponding printhead-to-media spacing is illustrated in FIG. 4, such spacing being identified as $S_e$. This distance must be sufficient to avoid smearing, but should not be so great as to significantly degrade the quality of print. In the preferred embodiment, $S_e$ is targeted at approximately 70-mils. This spacing is made difficult to determine, however, by the tendency of envelope layers to separate as the envelop leaves rollers 14. Separation of the envelope layers is caused by pinching of the record media as it leaves the paper guide. Pinching is effected by the edge 38 of paper guide 22. As indicated, separation of the envelope's layers compensates for the change in the angle of the platen upon rotation of pivot 18. The platen is at an angle $\theta_e$ when the pivot is in its nominal orientation (FIG. 4) but is at an angle $\theta_p$ when the platen is arranged to support single paper sheets (FIG. 5). The angle of the platen in FIG. 4 is approximately 5-degrees whereas the angle of the platen in FIG. 5 is only approximately 2-degrees.

As indicated in FIGS. 3 and 5, pivot 18 is provided with a catch 18b, which is arranged to engage the printer's chassis 34 so as to limit clockwise rotation of the pivot to a predetermined maximum extent. Maximum rotation of the pivot corresponds to a minimum record media gap. Catch 18a is thus positioned to engage the printer's chassis when the platen is in a second predetermined position, such position being defined at an optimal distance from the printhead for printing on thin record media such as single paper sheets. This arrangement results in a printhead-to-media spacing of $S_p$ (FIG.5), a spacing which is generally on the order of approximately 35-mils. Such spacing has been found to provide excellent print quality with a minimum risk of ink smear when printing on paper sheets.

Referring now specifically to the detector mechanism, it is to be noted that the detector includes a camming surface 40a which is nominally positioned in the record media path. The camming surface extends into the second transverse region of the record media path, and is thus engaged by relatively thin media, but not by relatively thick media such as envelope 20c. Upon engagement of camming surface 40a, tab 40 will be pivoted from the record media path, removing stop mechanism 44 from the path of the pivot, and allowing the pivot to rotate into the orientation shown in FIGS. 3 and 5. It will be appreciated that the camming surface must be engaged before the pivot is placed in its sheet-supporting orientation or the tab will be held in position by protuberance 42.

The detector includes a body 46 which is of a weight accommodating gravity-directed bias of the detector toward its nominal configuration without damage to the record media which engages the tab. The camming surface is at an obtuse angle relative to the record media path, reducing the impact on the record media when it engages the tab. As indicated, the record media will contact the camming surface on the detector, the paper being advanced forward with a force sufficient to slide the paper along the camming surface, thus raising the detector, as shown in FIGS. 3 and 5. Once the paper passes the camming surface, the tab will rest on the paper, the paper passing thereby with minimal opposition from the detector. The paper then will pass along the platen beneath the printer's printhead.

INUDSTRIAL APPLICABILITY

As previously indicated, the present invention is intended for use in an ink-jet printer, but may be used in virtually any style printer which requires adaption of the printer's record media throat. Similiary, the invented system may be used to detect various different types of record media, it being possible to adapt the system by changing the detector's transverse position or by employing multiple detectors.

While the present invention has been shown and described with reference to the foregoing operational principles and preferred embodiment, it will be apparent to those skilled in the art that other changes in form and detail may be made therein without departing from the spirit and scope of the invention as defined in the appended claims.

We claim:

1. In a printer which defines a path along which record media passes, and which includes a printhead and an opposing platen capable of movement toward and away from the printhead to define a record media gap therebetween, a record media gap adjustment system comprising:

a record media detector including a tab nominally positioned in the path of the record media, but movable from such path upon engagement by record media passing therealong; and a stop mechanism operatively coupled with said record media detector, said stop mechanism nominally being configured to halt platen movement at a first predetermined position so as to define a first predetermined record media gap, said stop mechanism automatically being reconfigurable upon detection of record media having a predetermined characteristic to allow movement of the platen to a second predetermined position so as to define a second predetermined record media gap.

2. The gap adjustment system of claim 1, wherein movement of said tab from the record media path effects reconfiguration of said stop mechanism.

3. The gap adjustment system of claim 1, wherein said tab carries said stop mechanism.

4. The gap adjustment system of claim 1, wherein said tab includes a camming surface which selectively is engaged by record media passing along the record media path.

5. The gap adjustment system of claim 4, wherein said camming surface confronts said record media at an obtuse angle relative to the record media path.

6. The gap adjustment system of claim 1, wherein said tab is pivotally movable from the record media path upon engagement by record media passing therealong.

7. The gap adjustment system of claim 6, wherein said tab normally is biased into the record media path by gravity.

8. In a printer which defines a path along which record media passes, and which includes a printhead and an opposing platen capable of movement toward and away from the printhead to define a record media gap therebetween, a record media gap adjustment system comprising:

a record media detector; and a stop mechanism operatively coupled with said record media detector, said stop mechanism nominally being configured to halt platen movement at a first predetermined position so as to define a first predetermined record media gap, said stop mechanism automatically being reconfigurable upon detection of record media having a predetermined characteristic to allow movement of the platen to a second predetermined position so as to define a second predetermined record media gap configured to actively detect record media having a width within a first width range, but to passively detect record media having a width within a second width range.

9. The gap adjustment system of claim 8, wherein said second width range is less than approximately 5-inches.

* * * * *